US005285655A

United States Patent [19]

Sung-Il et al.

[11] Patent Number: 5,285,655

[45] Date of Patent: Feb. 15, 1994

[54] REFRIGERATOR WITH FREEZER AIR DIRECTED OVER COOLER COMPARTMENT SHELF

[75] Inventors: Park Sung-Il, Kyonggi; Kim Myoung-Uk, Seoul; Lee Su-Il, Kyonggi, all of Rep. of Korea

[73] Assignee: Samsung Electronics Co., Ltd., Suwon, Rep. of Korea

[21] Appl. No.: 7,977

[22] Filed: Jan. 22, 1993

[30] Foreign Application Priority Data

Feb. 21, 1992 [KR] Rep. of Korea ..... 92 2701

[51] Int. Cl.[5] ..... F25D 23/06

[52] U.S. Cl. ..... 62/451; 62/405; 62/441; 62/443

[58] Field of Search ..... 62/440, 441, 443, 451, 62/405, 407, 448, 404, 453, 454

[56] References Cited

U.S. PATENT DOCUMENTS 2,740,266 4/1956 Kesling ..... 62/407
3,466,891 9/1969 Maxwell ..... 62/441

FOREIGN PATENT DOCUMENTS 229581 1/1990 Japan ..... 62/405

*Primary Examiner*—John M. Sollecito
*Attorney, Agent, or Firm*—Burns, Doane, Swecker & Mathis

[57] ABSTRACT

A refrigerator includes a freezing compartment and a refrigerating compartment located therebelow. A front door to the refrigerating compartment carries vertically spaced shelves for storing food. An air path extends from the freezing compartment to the respective shelves for permitting cold air from the freezing compartment to descend into the shelves to maintain an acceptably cool temperature in the shelves.

14 Claims, 2 Drawing Sheets

REFRIGERATOR WITH FREEZER AIR DIRECTED OVER COOLER COMPARTMENT SHELF

FIELD OF THE INVENTION

The present invention relates to a refrigerator having a freezing room and a refrigerating room, the latter having a door which carries food-storing shelves.

DESCRIPTION OF THE PRIOR ART

Generally, as shown in FIG. 1, a refrigerator is divided into a freezing room 100 and a refrigerating room 200. There is a special room 70 on the upper portion of the refrigerating room 200, and the special room 70 maintains the foods at a preferred temperature (about −2 degrees C. which is the temperature suitable for cooking the foods). On the bottom of the refrigerator, there is installed a compressor 74 for compressing the refrigerant, while an evaporator 72 is installed between the freezing room 100 and the refrigerating room 200. The refrigerant which is compressed by the compressor 74 is circulated through the refrigerator system, and the evaporator 72 cools the surrounding air through the action of the circulating refrigerant. A fan member 76 which is installed at the rear of the refrigerator body supplies the cooled air (cooled by the evaporator 72) to a chill path 77 which is installed at the rear of the refrigerator body. The cool air which is supplied to the chill path 77 passes through chill holes 78*a*–78*g*, 80 and 82*a*–82*c* to be supplied to the freezing room 100, the special room 70 and the refrigerating room 200.

Meanwhile, a heat insulating member 84 which is intended to maintain a temperature difference between the freezing room 100 and the refrigerating room 200 surrounds the upper, lower, left and right sides of the evaporator 72, and is disposed between the freezing room 100 and the refrigerating room 200.

Within the insulating member 84, there is formed a chill absorbing path 86 which connects the freezing room 100, the refrigerating room 200 and the evaporator 72. The chill absorbing path 86 extends to the freezing room 100 and the refrigerating room 200 to suck up warm air, and sends the warm air to the evaporator 72.

Further, doors 88 and 90 are installed on the freezing room 100 and the refrigerating room 200 on the front of the refrigerator. Within the refrigerating room door 90, there are installed first, second, third and fourth shelves 92*a*–92*d* for storing foods.

However, in the conventional refrigerator constituted as described above, the cool air is supplied from the evaporator 72 through the chill path 77 and the chill holes 78*a*–78*g*, 80 and 82*a*–82*c* to the freezing room 100 and to the refrigerating room 200. Therefore, before the cool air arrives at the first to fourth shelves 92*a*–92*d* within the refrigerating room door 90, the air has undergone a considerable heat exchange.

Consequently, the air supplied to the foods of the first to fourth shelves 92*a*–92*d*, is at a higher temperature thereby degrading the freshness of the foods.

SUMMARY OF THE INVENTION

The present invention is intended to overcome the above described disadvantages of the conventional techniques.

Therefore it is the object of the present invention to provide a refrigerator in which the cool air of the freezing room can be supplied to all the shelves of the refrigerating room, thereby making it possible to maintain fresh state of the foods.

In achieving the above object, the refrigerator of the present invention includes: a chill guiding path formed between the door of the refrigerating room and the door panel; and a chill circulating path for supplying the cool air from the freezing room to the chill guiding path.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Figure 1:
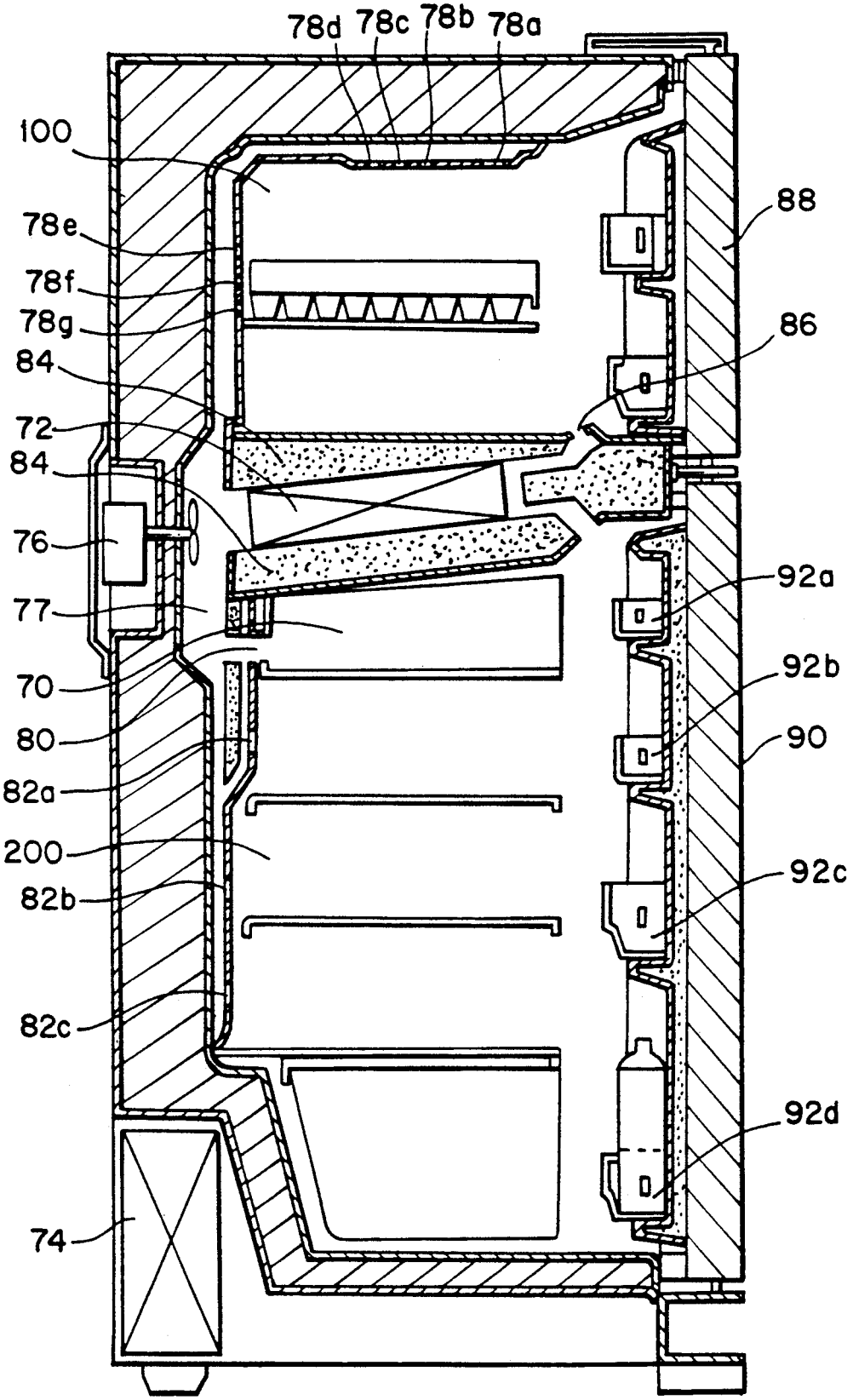
Fig. 1 PRIOR ART
FIG. 1 is a side sectional view showing the construction of a conventional refrigerator.
Figure 2:
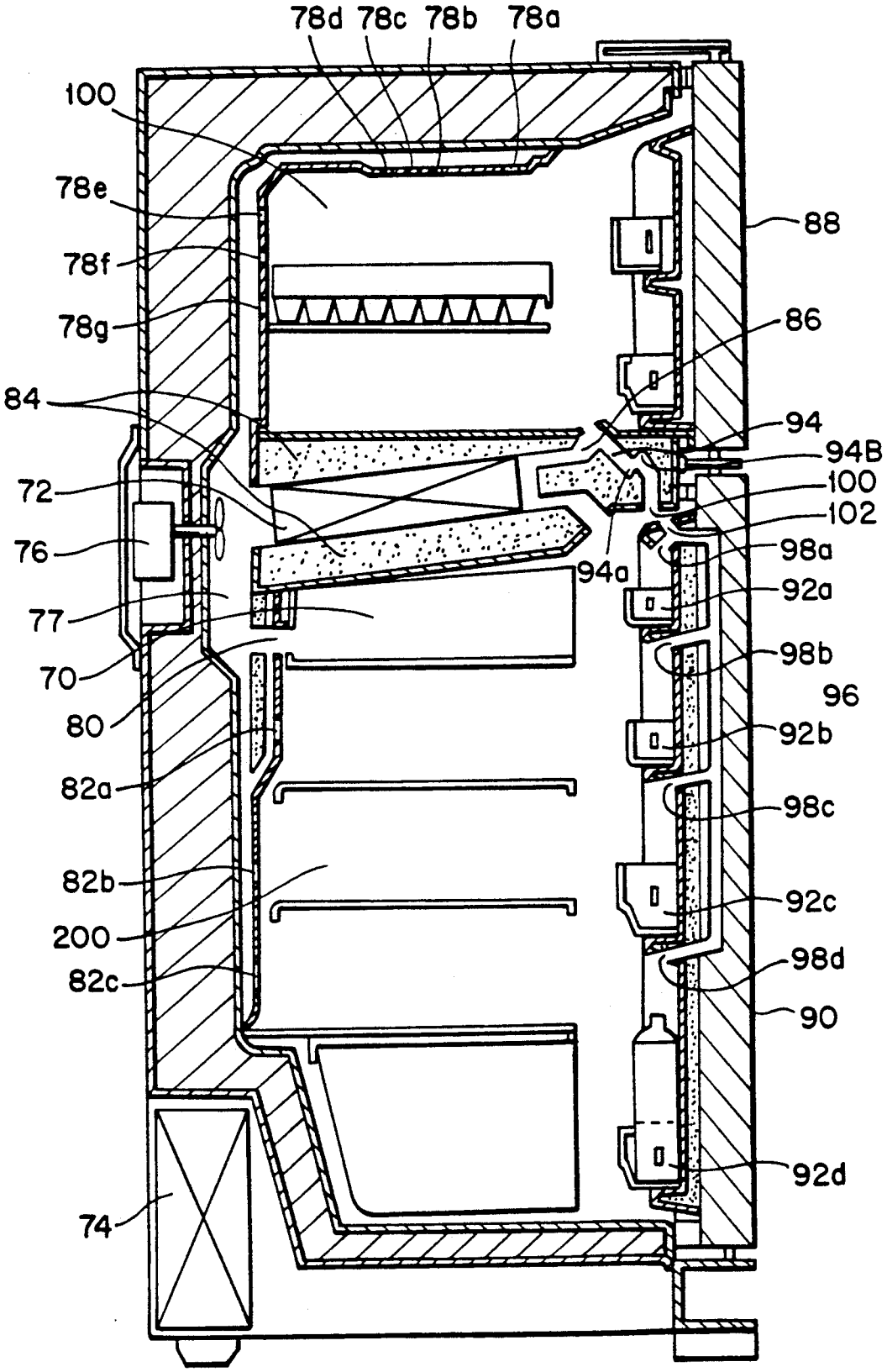
FIG. 2 is a side sectional view showing the construction of a refrigerator of the present invention.

FIG. 2 is a side sectional view showing the construction of the refrigerator according to the present invention.

Referring to FIG. 2, the refrigerator includes a freezing room 100 and a refrigerating room 200, while a special room 70 is formed on the upper portion of the refrigerating room 200.

The special room 70 maintains the foods at a temperature suitable for cooking (about −2 degrees C.).

A compressor 74 which is installed on the bottom of the refrigerator compresses the refrigerant and circulates it to an evaporator 72 which is installed between the freezing room 100 and the refrigerating room 200. The evaporator 72 cools the surrounding air through the action of the circulating refrigerant.

A fan member 76 which is installed at the rear of the refrigerator body supplies the cooled air (cooled by the evaporator 72) to a chill path 77 which is installed near the rear portion of the refrigerator body. The cool air which is supplied to the chill path 77 passes through chill holes 78*a*–78*g*, 80 and 82*a*–82*c* to be supplied to the freezing room 100, the special room 70 and the refrigerating room 200.

Meanwhile, a heat insulating member 84 which is installed to maintain a temperature difference between the freezing room 100 and the refrigerating room 200 surrounds the upper, lower, left and right sides of the evaporator 72, and is disposed between the freezing room 100 and the refrigerating room 200.

A chill absorbing path 86 is formed through the insulating member 84, and is connected through the freezing room 100 and the refrigerating room 200 to the evaporator 72. The chill absorbing path 86 receives the warm air which is warmed by being circulated through the freezing room 100 and the refrigerating room 200, and the warm air is supplied to the evaporator 72.

The refrigerator constituted as described above has doors 88 and 90 on the freezing room 100 and the refrigerating room 200. Inside the door 90 of the refrigerating room, there are installed first to fourth shelves 92*a*–92*d*, while a chill guiding path conduit 96 is formed between a door panel and the door 90 of the refrigerating room. The chill guiding path 96 is connected to a plurality of chill outlets 98*a*–98*d* which supply cool air to the first to fourth shelves 92*a*–92*d*. The chill guiding path 96 is so constituted as to be supplied with cool air from the freezing room 100 by a chill absorbing path conduit 94.

The chill absorbing path 94 which supplies cool air from the freezing room 100 to the chill guiding path 96 is formed through the insulating member 84 which is installed to maintain a temperature difference between the freezing room 100 and the refrigerating room 200. The chill absorbing path 94 which is thus formed through the insulating member 84 is bent up and down at least twice. The chill absorbing path 94 and the chill guiding path 96 are accurately connected (i.e., aligned) when the door 90 of the refrigerating room is closed.

Thus the chill of the freezing room 100 is supplied through the chill absorbing path 94 and through the chill guiding path 96 to the first to fourth shelves 92*a*-92*d*.

The refrigerator of the present invention constituted as above will now be described as to its operation and effects.

When the refrigerant which is compressed by the compressor 74 is circulated to the evaporator 72, the evaporator 72 cools the surrounding air through the action of the circulating refrigerant.

The cooled air is introduced into the chill path 77 by the action of the fan member 76. The cool air which is introduced into the chill path 77 passes through the chill boles 78*a*-78*g*, 80 and 82*a*-82*c* to be supplied to the freezing room 100, the special room 70 and the refrigerating room 200. The foods stored in the different partitions are frozen or refrigerated by the cool air which is supplied through the chill holes 78*a*-78*g*, 80 and 82*a*-82*c* to the freezing room 100, the special room 70 and the refrigerating room 200. Particularly, the special room 70 maintains the foods at about −2 degrees C., thereby keeping the foods suitable for cooking. The cool air is subjected to heat exchanges during the circulations through the freezing room, the special room and the refrigerating room, and the warm air which is formed as a result of the heat exchanges is introduced into the chill circulating path 86.

The warmed air which is introduced into the chill circulating path 86 is cooled down again by the evaporator 72, and is supplied again by the fan member 76 through the chill path 77 and through the chill holes 78*a*-78*g*, 80 and 82*a*-82*c* to the freezing room 100, the special room 70 and the refrigerating room 200.

Under this condition, the cool air which is supplied to the freezing room 100 circulates within the freezing room 100, and then, a part of it is circulated from the freezing room 100 toward the evaporator 72, while the rest of it is introduced into the chill absorbing path 94.

The chill absorbing path 94 which is formed within the insulating member 84 has a twice or more bent contour. That is, it changes direction at least twice in the vertical direction, e.g., it turns upwardly at bend 94A and turns downwardly at bend 94B. Owing to this bent contour of the chill absorbing path 94, the warmed air which is produced within the refrigerating room 200 cannot rise through the path 94 and enter the freezing room 100. In a rare possible case, even if the warmed air which is heated within the refrigerating room 200 is introduced into the chill absorbing path 94, the low temperature air which descends from the freezing room 100 cools down the ascending warm air within the chill absorbing path 94, and blocks the rising of the warm air.

Meanwhile, the cool air which is introduced from the freezing room into the chill absorbing path 94 is supplied directly to the chill guiding path 96 since the lower outlet end 100 of the path 94 is situated immediately adjacent the air inlet end 102 of the path 96. That cool air is then supplied through the chill outlets 98*a*-98*d* to the first to fourth shelves 92*a*-92*d* which are disposed at the rear of the door 90. Thus the foods which are stored on the first to fourth shelves are refrigerated by the cool air which is released through the chill outlets 98*a*-98*d*.

The chill outlets 98*a*-98*d* should desirably enter the first to fourth shelves 92*a*-92*d* from a location thereabove, so that the cool air can descend onto the food stored in the shelves.

It will be appreciated that the chill absorbing path 94 and the chill guiding path 96 constitute first and second sections, respectively, of a path interconnecting the freezing room 100 with the shelves.

As described above, the refrigerator of the present invention includes a freezing room and a refrigerating room, and further includes a chill absorbing path through the insulating member and beside the door, and still further includes a chill guiding path in connection with the chill absorbing path to circulate cool air from the freezing room to the different shelves.

Therefore the refrigerator of the present invention increases the cooling effect for the foods of the shelves, thereby improving the freshness of the stored foods.

The above descriptions were made based on the specific preferred embodiment, but it should be apparent that various modification can be added without departing from the scope of the present invention.

For example, the above descriptions were made only for the refrigerating room, but the same arrangement can be applied to the freezing room, thereby achieving the same effect.

Further, the number of the shelves were restricted to four, but the number of the shelves should be variable.

Further, the configurations of the chill absorbing path and the chill guiding path need not be restricted to the specifically described embodiment, but various modifications can be made by those ordinarily skilled in the art.

What is claimed is:

1. A refrigerator including a freezing room and a refrigerating room, said refrigerating room including a door having at least one shelf on an inner side thereof for storing food, and conduit-defining means defining a conduit located directly above said shelf directly communicating said at least one shelf with said freezing room so that in a normal operating mode cool air descends directly downward from said freezing room to said shelf.

2. A refrigerator according to claim 1 including insulation disposed between said refrigerating room and said freezing room, said conduit including a first conduit section extending through said insulation.

3. A refrigerator according to claim 2, wherein said first conduit section changes direction vertically at least twice to resist the upward travel of warmer air therethrough.

4. A refrigerator according to claim 3, wherein said at least one shelf comprises a plurality of shelves, said conduit including a second conduit section communicating with each of said shelves.

5. A refrigerator according to claim 4, wherein said door comprises a panel, said second conduit section being formed between said shelves and said panel.

6. A refrigerator according to claim 5, wherein said second conduit section communicates with said shelves at locations above said shelves.

7. A refrigerator according to claim 1, wherein said at least one shelf comprises a plurality of shelves, said conduit including a second conduit section communicating with each of said shelves.

8. A refrigerator according to claim 7, wherein said door comprises a panel, said second conduit section being formed between said shelves and said panel.

9. A refrigerator according to claim 7, wherein said second conduit section communicates with said shelves at locations above said shelves.

10. A refrigerator according to claim 1 including an evaporator located in an insulated space between said freezing room and said refrigerating room, a compressor for delivering refrigerant to said evaporator, circulating means for circulating cool air from an air outlet of said evaporator to said freezing space and said refrigerating space, said freezing room and said refrigerating room communicating with an air inlet of said evaporator.

11. A refrigerator according to claim 10, wherein said refrigerating room and said freezing room communicate with said air inlet of said evaporator at a front portion of said refrigerator adjacent said door, said circulating means communicating with said air outlet of said evaporator adjacent a rear portion of said refrigerator.

12. A refrigerator according to claim 10, wherein said freezing room is disposed above said refrigerating room, said conduit including a first conduit section extending through said insulated space, and a second conduit section formed in said door, a lower end of said first conduit section communicating with an upper end of said second conduit section.

13. A refrigerator according to claim 1 wherein said freezer room is separated from said refrigerating room by an insulated space, said conduit including first and second conduit sections, said first conduit section extending through said insulated space, said second conduit section formed in said door, a lower end of said upper conduit section being disposed immediately adjacent an upper end of said lower conduit section communicate therewith.

14. A refrigerator including a freezing room and a refrigerating room, said refrigerating room including a door having at least one shelf on an inner side thereof for storing food, path-defining means defining a path communicating said at least one shelf with said freezing room so that cool air from said freezing room can descend to said shelf, an evaporator located in an insulated space between said freezing room and said refrigerating room, compressor for delivering refrigerant to said evaporator, and circulating means for circulating cool air from an air outlet of said evaporator to said freezing space and said refrigerating space, said freezing room and said refrigerating room communicating with an air inlet of said evaporator, said refrigerating room and said freezing room communicating with said air inlet of said evaporator at a front portion of said refrigerator adjacent said door, said circulating means communicating with said air outlet of said evaporator adjacent a rear portion of said refrigerator, said freezing room being disposed above said refrigerating room, said path including a first section extending through said insulating space, and a second section formed in said door, a lower end of said first section communicating with an upper end of said second section.

* * * * *